US005406896A

United States Patent [19]

Jacobson

[11] Patent Number: 5,406,896

[45] Date of Patent: Apr. 18, 1995

[54] SECURITY BOX FOR INSTALLATION IN A SAFE

[75] Inventor: Christer Jacobson, Partille, Sweden

[73] Assignee: AB Catusafe, Goteborg, Sweden

[21] Appl. No.: 689,762

[22] Filed: May 30, 1991

[30] Foreign Application Priority Data

Dec. 5, 1988 [SE] Sweden ..... 8804397

[51] Int. Cl.[6] ..... E05G 1/12

[52] U.S. Cl. ..... 109/29; 109/57

[58] Field of Search ..... 109/20, 25, 29, 33, 109/36, 42–44, 53, 54, 56, 57, 45, 49, 68

[56] References Cited

U.S. PATENT DOCUMENTS

| | | | |
|---|---|---|---|
| 952,761 | 3/1910 | Smith . | |
| 1,010,259 | 11/1911 | Hill | 109/57 X |
| 1,168,914 | 1/1916 | Spivey et al. | 109/45 |
| 1,184,094 | 5/1916 | Harrington . | |
| 3,344,757 | 10/1967 | Touyet | 109/25 |
| 3,587,484 | 6/1971 | Munton . | |
| 4,236,463 | 12/1980 | Westcott | 109/33 |
| 4,391,203 | 7/1983 | Millar | 109/25 |
| 4,425,853 | 1/1984 | McGregor et al. . | |
| 4,569,294 | 2/1986 | Beattie et al. | 109/45 |
| 4,722,435 | 2/1988 | Mareels et al. | 109/25 X |
| 4,799,435 | 1/1989 | Boutroy | 109/25 |
| 4,852,502 | 8/1989 | Klingberg et al. | 109/25 |

FOREIGN PATENT DOCUMENTS

| | | | |
|---|---|---|---|
| 0381976 | 12/1986 | Austria . | |
| 0190778 | 8/1986 | European Pat. Off. . | |
| 0241322 | 10/1987 | European Pat. Off. . | |
| 7702239 | 12/1978 | Sweden . | |
| 1446711 | 8/1976 | United Kingdom | 109/20 |
| 2157363 | 10/1985 | United Kingdom | 109/58 |

*Primary Examiner*—Peter M. Cuomo
*Assistant Examiner*—Suzanne L. Dino
*Attorney, Agent, or Firm*—Young & Thompson

[57] ABSTRACT

The invention relates to a security box, preferably for installation in a safe or the like, of the type comprising a six-sided box (1) of metal, for example. According to the invention, a detector is disposed to detect improper opening of the box, a protective shell (9) is disposed to detect damage to the box, an electronics unit (11) is disposed to trigger a dye system if improper opening or damage is detected, and the dye system is disposed, upon triggering, to discolor the contents of the box.

1 Claim, 3 Drawing Sheets

SECURITY BOX FOR INSTALLATION IN A SAFE

FIELD OF THE INVENTION

The present invention relates to a security box, preferably for installation in a safe, strong-box or the like, and of the type comprising a six-sided box of metal, for example.

BACKGROUND OF THE INVENTION

It is a well known problem that safes are sometimes subjected to mechanical damage in connection with burglaries. If the burglary is successful, currency and other negotiable documents stored in the safe can be used by the burglars despite substantial damage to the safe.

Insurance companies normally assign each type of safe a highest value of the content stored therein, for which compensation can be given by the insurance company in the event of a burglary. Amounts in excess thereof stolen from such a safe are not reimbursed by the insurance company. Due to, among other things, inflation, older safes thus have a lower and lower "utility value" for the user and it would be desirable to be able to increase the amount which can be stored in the safe.

In order to discourage burglars from breaking into safes and at the same increase the monetary value which can be stored in old or new safes, the present invention is suggested.

It is of course previously known to place special boxes or cassettes in large safes or strong-boxes. These boxes are normally only provided with ordinary locks, but they can also be provided with combination locks. The boxes are often pre-mounted at the factory and are often provided with some sort of alarm device.

One example of the latter is described in Austrian patent specification No. 381976, where a safe with an inner module is provided with an electronic monitoring unit.

U.S. patent specification No. 952,761 describes providing a safe with an inner box, the door of which is mechanically coupled to a tube element containing chemicals designed to discolor currency and negotiable documents stored in a compartment in the box. The tube element is broken mechanically if the door to the box is opened in an improper manner.

SUMMARY OF THE INVENTION

The purpose of the present invention is to achieve a security box, which, in addition to new safes, can also be installed in existing safes, and which is disposed, upon tampering or improper opening, to discolor currency or negotiable documents stored therein. This is achieved according to the invention by virtue of the fact that a detector is arranged to sense improper opening of the box, that a protector shell is arranged to detect damage to the box, that an electronics unit is arranged to activate the dye system when improper opening or damage is detected, and that the dye system is arranged, when triggered, to color the contents of the box.

BRIEF DESCRIPTION OF THE DRAWINGS

The invention will be described below as an example with reference to the accompanying drawings, in which.

DESCRIPTION OF THE PREFERRED EMBODIMENT

Figure 1:
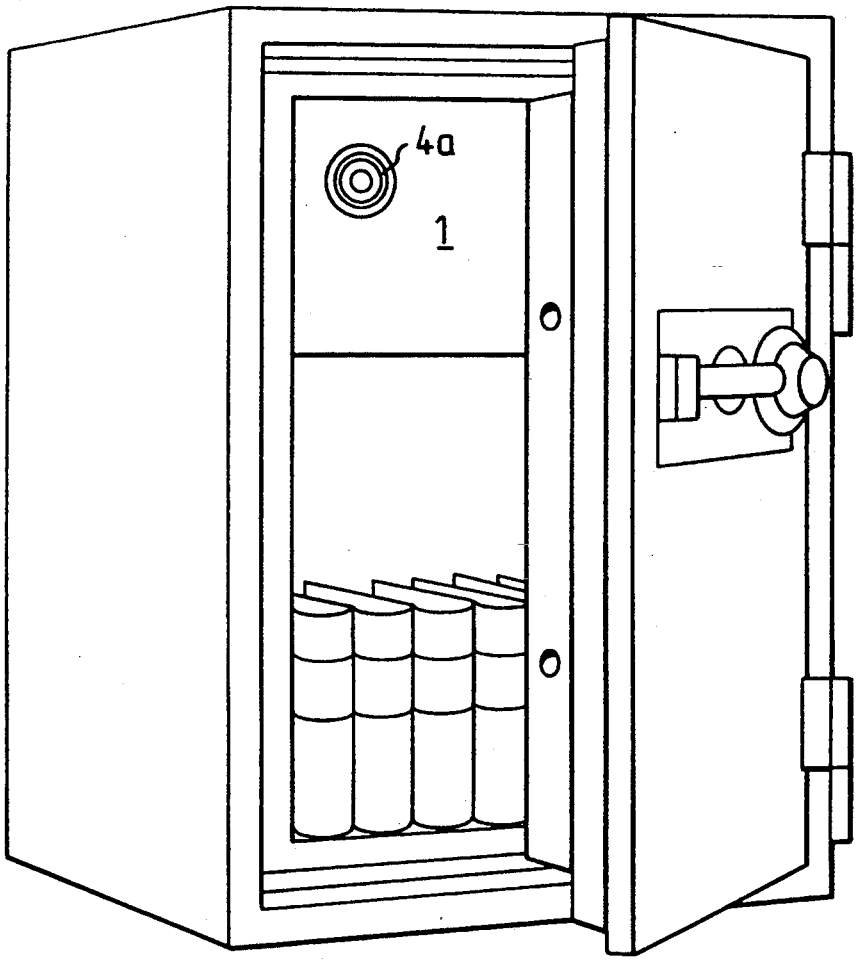
FIG. 1 shows a common safe, the upper portion of the interior of which has been provided with a security box according to the invention.
Figure 2:
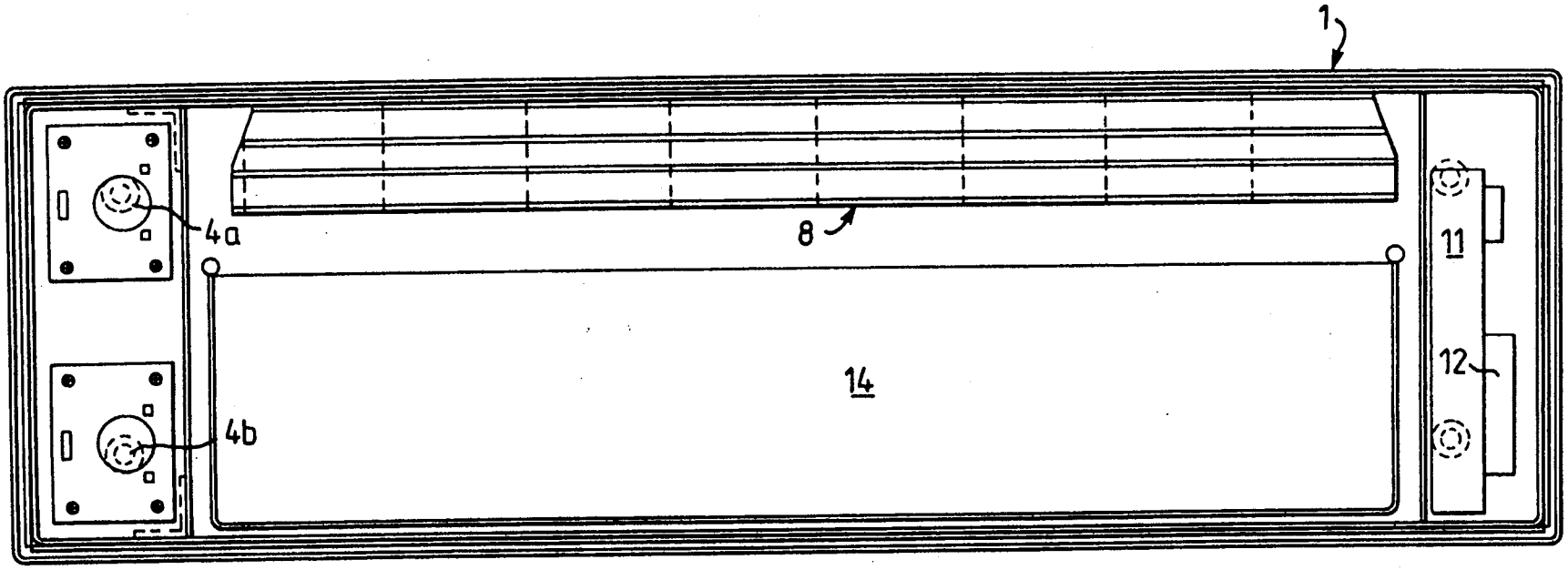
FIG. 2 shows the security box from the front.

The invention consists of a security box 1 for installation in a safe 2 or the like. In the security box 1 there can be stored currency, negotiable documents or other valuables.

The security box 1 consists of an essentially rectangular box with rigid walls on five sides and an openable front cover 3. In a preferred embodiment, the outer casing 13 of the security box is made of 2 mm steel. The cover 3 is provided with two separate locks *4a, 4b,* which in their locked positions, engage in cavities placed in the security box 1. The security box 1 has essentially two modules *6a, 6b,* containing an electronics unit 11, microswitches *7a, 7b,* rechargeable batteries 12, etc. In the top of the box 1, there is arranged a dye system 8, known per se, in the form of a dye cartridge. The dye system contains a liquid dye substance which is resistant to most solvents and, consequently, very difficult to remove. The dye substance is placed in a cartridge and is spread by detonation of a small explosive.

Figure 3A:
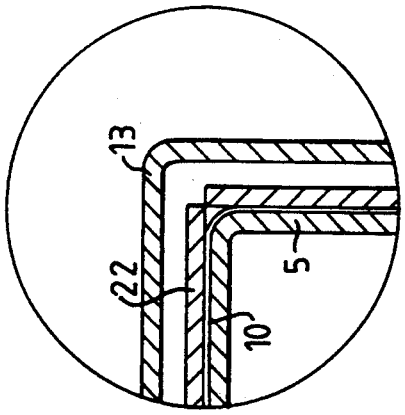
FIG. 3A shows a magnified view of protective shell 9 of FIG. 3.
Figure 3:
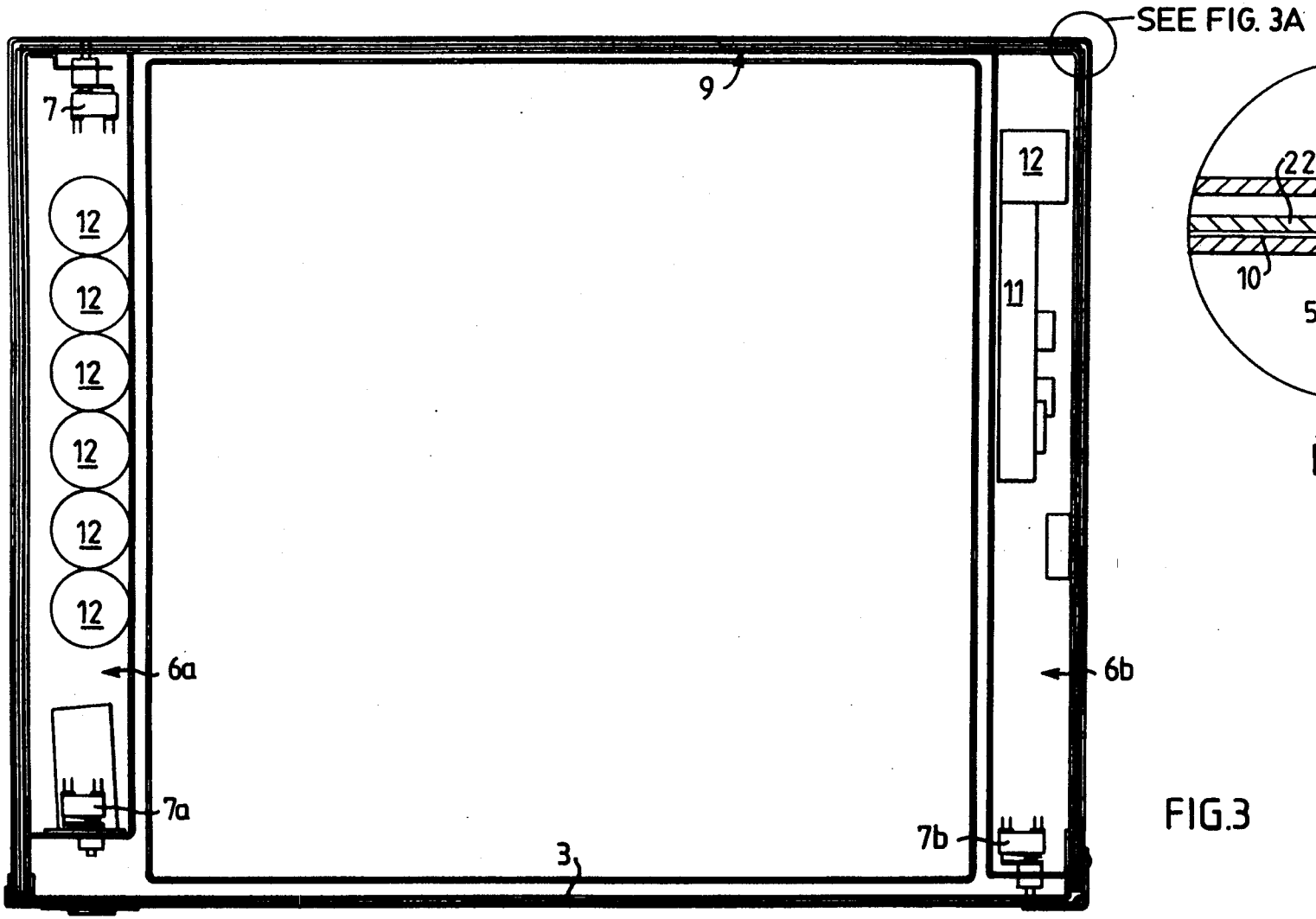
FIG. 3 shows the security box from above (top removed).

The security box 1 is further provided between the outer casing and an inner box 5 with a protective shell 9 which consists of a laminate with net layers. As seen in FIG. 3A, the laminate 22 adheres to the surfaces to be protected from damage, i.e. all of the sides of the box and the cover, and this can be done with the aid of double adhesive tape 10. The laminate is electrically connected to the electronics unit 11 of the security box. The nets are rather fine, about 2 $mm^2$, which makes it practically impossible to penetrate, with mechanical means, the sides of the security box 1 or the cover 3 without triggering the dye system 8.

The dye system 8 is placed in such a manner in the upper portion of the security box 1 that it is possible to place currencies, cheques or other valuables in a net basket 14, for example, under it. If the security box is subjected to damage or if the two locks *4a, 4b* are opened with too long a time interval, for example, the dye system 8 is triggered and the contents of the box is discolored. The currency or negotiable documents will therefore, in practice, be unusable.

The security box 1 is also provided with sensors for temperature and moisture and an audible signal indicates a drop in voltage. If the battery voltage drops below a certain level and the security box 1 is not activated within for example 30 days, the dye system 8 is triggered. The security box 1 is also provided with a double battery package to eliminate the risk of bullet damage.

Microswitches *4c* or the like can be arranged in the sides of the security box and/or its rear wall to trigger the dye system 8 if the box is removed from the safe without the box first being unlocked in an authorized manner.

The security box according to the invention can thus be permanently mounted in a safe 2 by fasteners. e.g. screws, mounted from inside the box. The box can of course be removed from a safe and moved to another safe, provided the box is opened by authorized personnel.

The invention is of course not limited to the embodiment described above. Rather a number of variants are conceivable within the scope of protection of the claims.

I claim:

1. A safe, comprising a main space and a security space separated from the main space and containing a dye system arranged to be triggered by a detector detecting improper opening of a lockable door closing the security space in order to color the contents of said security space, wherein said security space is formed by a security box detachably mounted in the main space and having a protective shell arranged to detect damage to the security box, said protective shell being electrically connected to an electronic unit which is arranged to trigger the dye system upon detection of such damage, said electronic unit including means for sensing improper removal of the security box from the main space and, in that case, to trigger the dye system.

* * * * *